US005759071A

United States Patent [19]

Hanning et al.

[11] Patent Number: 5,759,071

[45] Date of Patent: *Jun. 2, 1998

[54] POWER DISTRIBUTING MEANS AFFORDING LATERAL LOAD TRANSFER

[75] Inventors: Walter Hanning, Detmold; Michael Schnatwinkel, Herford; Manfred Wilmes, Detmold, all of Germany

[73] Assignee: Weidmueller Interface GmbH & Co., Detmold, Germany

[ * ] Notice: The term of this patent shall not extend beyond the expiration date of Pat. No. 5,651,702.

[21] Appl. No.: 549,645

[22] Filed: Oct. 27, 1995

[30] Foreign Application Priority Data

Oct. 31, 1994 [DE] Germany ..... 44 38 803.9

[51] Int. Cl.[6] ..... H01R 9/26

[52] U.S. Cl. ..... 439/716

[58] Field of Search ..... 439/709, 715, 439/716, 507, 511, 721, 723, 724, 717

[56] References Cited

U.S. PATENT DOCUMENTS 5,318,461 6/1994 Frikkee et al. ..... 439/715

5,651,702 7/1997 Hanning et al. ..... 439/715

FOREIGN PATENT DOCUMENTS

| | | |
|---|---|---|
| 0222030 | 5/1987 | European Pat. Off. . |
| 3048497 | 7/1982 | Germany . |
| 68912040 | 6/1994 | Germany . |
| 4322535 | 1/1995 | Germany . |
| 29514509 | 12/1995 | Germany . |

*Primary Examiner*—Gary F. Paumen
*Assistant Examiner*—Christopher Goins
*Attorney, Agent, or Firm*—Laubscher & Laubscher

[57] ABSTRACT

A terminal block assembly includes a plurality of terminal blocks at least one of which contains plurality of interconnected distributor bars having at least a pair of terminal assemblies electrically connected by a bridge member. Each terminal assembly includes a terminal having a resilient contact portion and a stationary base portion, and further includes a bus bar containing a plug-receiving gap. The bus bar is provided with a plug-in link projection adapted for insertion within the plug-receiving gap of a terminal contained in the next adjacent terminal block. In this manner, a pair of terminals contained within the same terminal block are electrically connected via the bridge members, and terminals contained in adjacent terminal blocks are electrically connected via the plug-in link projections.

8 Claims, 2 Drawing Sheets

POWER DISTRIBUTING MEANS AFFORDING LATERAL LOAD TRANSFER

REFERENCE TO RELATED APPLICATION

This application is a companion to the applicant's copending U.S. application Ser. No. 08/550,115 filed Oct. 30, 1995, now U.S. Pat. No. 5,651,702 issued Jul. 29, 1997, entitled "Terminal Block Assembly With Terminal Bridging Member."

BACKGROUND OF THE INVENTION

1. Field of the Invention

The present invention relates to a terminal block assembly wherein at least one terminal block includes a plurality of terminals which are electrically connected by means of a conductive bridge member bridge, which terminals include lateral projections for connection with adjacent terminals contained in adjacent terminal blocks, thereby to provide lateral distribution of electrical power.

2. Brief Description of the Prior Art

Various devices are known in the prior art which include bridging elements which allow for the connection of terminals inside a terminal block assembly and which are suitable for conducting potentials between distributor bars in the direction of the terminal block assembly. Such devices are used, for example, in connecting electrical components such as voltage sources, signal receivers, sensors, actuators, and field units and are also frequently used in control systems with a modular structure. Examples of such devices are shown in, for example, German patents Nos. DE 43 22 535 A1, DE 30 48 497 A1, and DE 68 91 20 40 T2. In these prior devices, the lateral or cross-distribution is accomplished using one distributor bar and, as a result, the conducting of the potential does not leave the distributor bar. Consequently, only connection elements are connected to each other in the direction of the terminal block assembly. This results in a failure of the neighboring distributor bars to be reliably brought to the same potential.

The present invention was developed to overcome these and other drawbacks of the prior devices by providing an improved terminal block assembly in which distributor bars including terminals that are bridged together and include plug-in link portions which provide lateral or cross-distribution of electrical power to terminals contained in adjacent terminal blocks. Accordingly, a plus potential is conducted from a first distributor bar via the bridge to a parallel arranged distributor bar that leads to a certain pole number of that plug potential. The electrical contact bridge includes resilient contact legs which produce a strong contact force during the bridging transfer of the potential from one distributor bar to a second parallel arranged distributor bar. Such a branching arrangement is especially useful in large complex modular control systems because it allows such systems to be branched and wired in a space saving and flexible manner.

SUMMARY OF THE INVENTION

Accordingly, a primary object of the present invention is to provide an improved terminal block assembly which affords lateral or cross-distribution of electrical power. The terminal block assembly includes a plurality of parallel adjacent terminal blocks including a pair of electrical terminals connected via a conductive bridge member. Each terminal includes a contact having a resilient portion, a stationary portion, and a bus bar laterally spaced from the stationary portion to define a gap. The bus bar includes a lateral projection or plug-in link portion which engages the gap of a terminal contained in an adjacent terminal block, thereby to provide lateral distribution of an electrical supply.

It is a further object of the invention to provide a distributor bar having an insulating housing shell which provides protection against damage resulting from contact, protects users handling the apparatus, and acts to firmly hold the bridge on the distributor bar.

It is another object of the invention to provide a bridge having an upper rail portion and at least one pair of spaced leg portions defining a slot adapted to receive the lateral projection of the distributor bar.

It is a yet further object of the invention to provide a plurality of neighboring distributor bars which can be reliably brought to the same potential.

BRIEF DESCRIPTION OF THE DRAWINGS

Other objects and advantages of the invention will become apparent from a study of the following specification when viewed in light of the accompanying drawings, in which.

DETAILED DESCRIPTION

Figure 1:
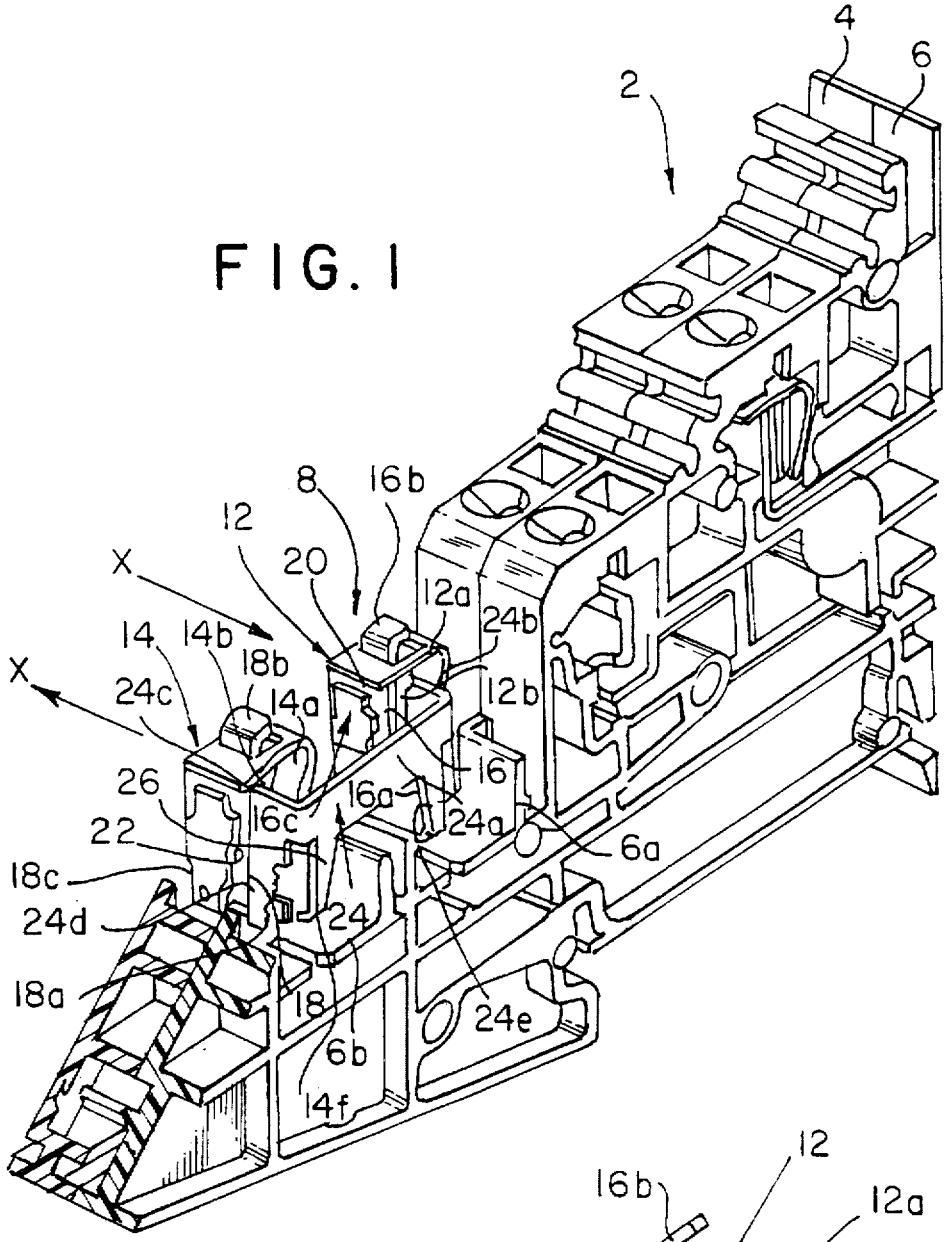
FIG. 1 is a perspective view of the terminal block assembly according to the invention.
Figure 5:
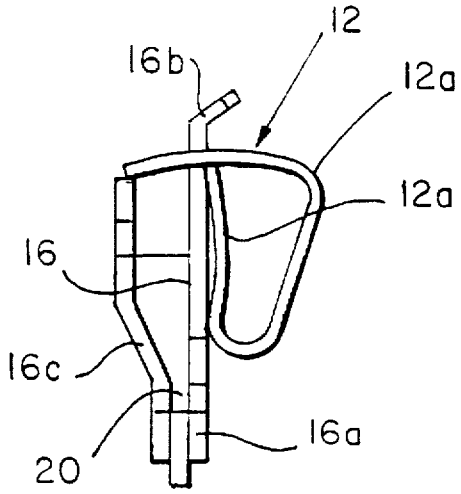
FIG. 5 is a detailed side elevational view of the resilient terminal arrangement of the applicant's companion U.S. application Ser. No. 08/550,115 filed Oct. 30, 1995, now U.S. Pat. No. 5,651,702.

Referring first to FIG. 1, a terminal block assembly 2 includes a pair of adjacent parallel terminal blocks 4, 6, although, of course, any number of such similarly arranged terminal blocks may be provided. Such a terminal block assembly may belong to, for example, a modular control system. Distributor bars 8, 10 are arranged generally parallel in terminal block seats **6*a*, 6*b*, respectively. The distributor bars serve to supply power to sensors, initiators, actuators, field units, and the like. The distributor bars include resilient generally loop-shaped electrical terminal means 12 and 14 associated with corresponding bus bars 16 and 18, respectively. The terminals include movable first portions 12*a* and 14*a* that contain openings for receiving the associated end portions 16*b* and 18*b* of the bus bars, respectively, and stationary second portions 12*b* and 14*b* that extend in side-by-side engagement with the body portions of the bus bars 16 and 18, respectively. The bus bars include parallel spaced second portions 16*c* and 18*c* that define plug-receiving gaps or slots 20,22 respectively. The structural details of the bus bar and resilient terminal arrangement are best shown in FIG. 5 (which corresponds generally with FIG. 3** of applicant's aforementioned companion application Ser. No. 08/550,115, now U.S. Pat. No. 5,651,702, and forms no part of the present invention).

In accordance with a characterizing feature of the invention, laterally extending projections or plug-in link portions **16*a*, 18*a*** are provided on the respective bus bars and extend into the plug-receiving gaps of terminals contained in adjacent terminal blocks, thereby to provide lateral distribution of an electrical supply. Alternatively, the plug contact elements could be oriented toward the outside end or side of the terminal in the direction of the terminal block.

A conductive bridge member 24 acts to connect adjacent distributor bars 8, 10. The bridge member includes an upper rail portion **24*a* having inwardly extending end portions 24*b*, 24*c*, whereby the overall length of the bridge is within the dimension of the adjacent terminals, that is, between resilient portion 12***a* of distributor bar 8 and stationary portion 14*b* of distributor bar 10. This facilitates an arrangement within the grid pattern of the distributor bars in their entirety and allows a high conducting current transmission cross-section with the contact.

Each end of the bridge member includes a pair of resilient legs which extend downwardly from the upper rail portion 24*a*, one pair being associated with each distributor bar, respectively. Referring to the resilient leg pair associated with distributor bar 10, an end leg portion 24*d* extends downwardly from inwardly extending end portion 24*c* and a spaced leg portion 24*f* extends downwardly from the upper rail portion 24*a*. Leg pair 24*d*, 24*f* thereby defines a vertical slot 26 therebetween adapted to receive a lateral projection 18*a* of bus bar 18 when the bridge is attached to adjacent distributor bar 10. In this manner, electrical cross-connection is established between the distributor bars without any separate cross-connector assembly and is established automatically during the assembly of the distributor bars. Moreover, enough space is available to provide the input zone for the lateral projection 18*a* into the plug slit 26 between the leg pairs with an insertion slope or an insertion funnel which facilitates the action of sticking the contact bridge 24 on the lateral projections 16*a*, 18*a*.

The lateral projections or plug-in link portions 16*a* and 18*a* are oriented toward and protrude from the terminal to engage the bridge 24 and, thereby bring the potential of the first distributor bar 8 via the bridge to the parallel located distributor bar 10. This is illustrated by the two arrows in FIG. 1. The arrows also symbolize that such distributor bars can be made up of a large number of individual connections.

Figure 2:
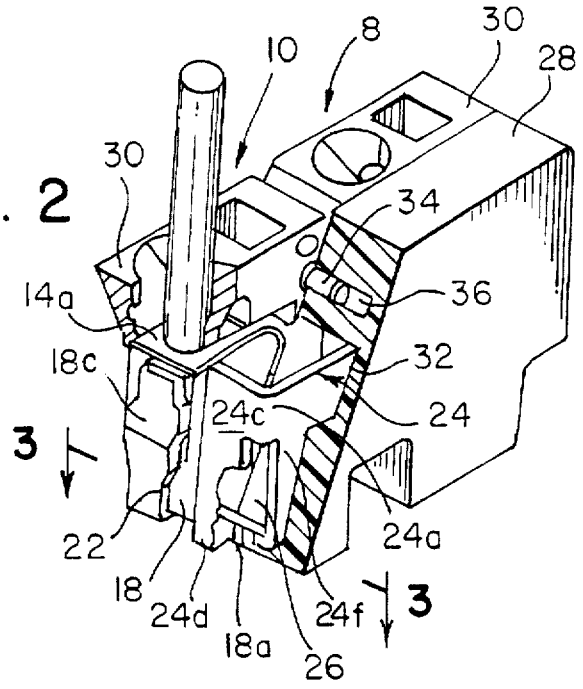
FIG. 2 is a perspective view of a terminal block assembly provided with an insulating housing shell.

Referring now to FIG. 2, there is shown a distributor bar having a bridge housing shell 28 and a terminal housing 30. Bridge housing shell 28 is formed of a suitable insulating plastic material and serves to provide protection against contact with foreign objects and provides further protection to individuals handling the apparatus. Housing shell 28 contains a recess 32 adapted to receive the upper rail portion 24*a* of the bridge which is locked in place. Housing shell 28 further acts to fixedly connect bridge 24 with two adjacent distributor bar 8, 10 and, therefore, helps secure the electrical contact against stress due to shaking and stress due to the force of gravity with regard to a corresponding spatial position of distributor bars 8, 10 and bridge 24.

The side of the terminal housing 30 adjacent the bridge housing 28 includes a plurality of protruding catch pins 34 and the bridge housing 28 contains catch pin recesses 36 adapted to receive the corresponding catch pins. In this way, the catch pins act to mechanically lock the bridge housing together with the terminal housing and, thereby lock the bridge with the corresponding terminals.

Figure 3:
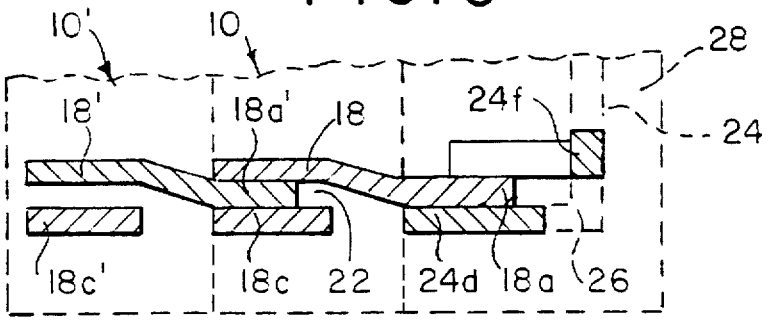
FIG. 3 is a somewhat dragrammatic view taken along line 3—3 of FIG. 2.

FIG. 3 illustrates the lateral connection of terminals contained in adjacent terminal blocks. The lateral projection 18*a*' of a first distributor bar 10' extends into the plug-receiving gap 22 of an adjacent distributor bar 10. The side of the terminal contained in distributor bar 10 adjacent distributor bar 10' is open to receive the lateral projection and, thereby complete the connection. Bridge housing 28, on the other hand, completely encloses bridge 24*d*, 24*f* and lateral projection 18*a*, thereby precluding further cross-connection.

Figure 4:
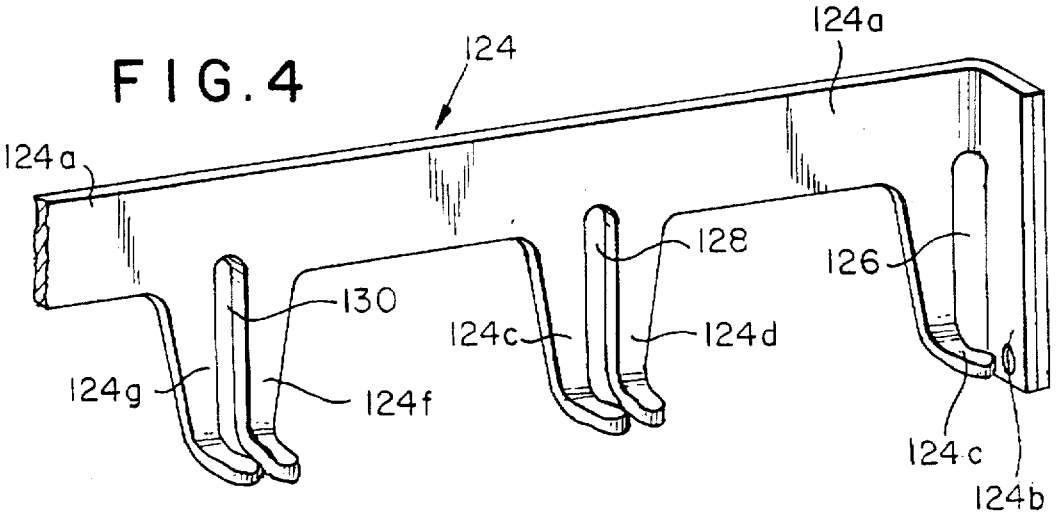
FIG. 4 is a perspective view of a bridge having multiple plug-in link portions.

A multi-pole bridge 124 is shown in FIG. 4. The bridge member includes an elongated upper rail portion 124*a* one end of which is bent inwardly and includes a downwardly extending portion forming an end leg portion 124*b*. A leg portion 124*c* extends downwardly from upper rail portion 124*a* to define a slot 126 between leg portion 124*c* and end leg portion 124*b*. A plurality of leg pairs 124*d*, 124*e* and 124*f*, 124*g* extend downwardly from upper rail portion 124*a* and define slits 128 and 130, respectively. While only two such leg pairs are shown, any number of such leg pairs may be provided.

While in accordance with the provisions of the Patent Statutes the preferred forms and embodiments of the invention have been illustrated and described, it will be apparent to those of ordinary skill in the art that various changes and modifications may be made without deviating from the inventive concept set forth above.

What is claimed is:

1. A terminal block assembly (2), comprising:

(a) a plurality of parallel adjacent terminal blocks (4,6);

(b) a plurality of distributor bars (8,10) mounted on said terminal blocks, respectively, each of said distributor bars including:

(1) a resilient contact having a movable portion (12*a*, 14*a*) and a stationary portion (12*b*,14*b*);

(2) stationary bus bar means (16,18) electrically connected with said resilient contact, said bus bar means including:

(a) a laterally extending first tab portion (16*a*,18*a*);

(b) said bus bar means containing a slot (20,22) for receiving the first tab portion of an adjacent distributor bar mounted on another terminal block when said terminal blocks are arranged in side-by-side relation; and (c) conductive bridge means (24) for electrically connecting the first tab portions of a pair of distributor bars mounted on the same terminal block.

2. Apparatus as defined in claim 1, wherein said conductive bridge means includes:

(a) an upper rail portion (24*a*); and (b) at least one pair of spaced leg portions (24*d*,24*f*) expending downwardly from said upper rail portion, said leg portions defining a slot (26) adapted to receive the lateral bus bar projection (18*a*) of the adjacent distributor bar.

3. Apparatus as defined in claim 2, wherein said bridge means includes at least one orthogonally inwardly bent end portion (24*c*), the length of said bridge member being less than the corresponding dimension between the remote faces of adjacent distributor bars (8,10).

4. Apparatus as defined in claim 3, wherein said inwardly bent end portion (24*c*) includes one of said downwardly extending resilient end leg portions (24*d*).

5. Apparatus as defined in claim 3, wherein said bridge means includes a plurality of leg pairs (124*d*, 124*e* and 124*g*, 124*f*) arranged between said end portions (124*b*).

6. Apparatus as defined in claim 1, and further comprising a bridge insulating housing (28) enclosing the side of said bridge means remote from the associated pair of distributor bars; distribution bar insulating housings (30) enclosing the sides of said resilient contact and said bus bar means of each of said distributor bars remote from said bridge means; and means for locking said distributor bar housings with said bridge housing.

7. Apparatus as defined in claim 6, wherein said bridge means is fixedly mounted on said bridge housing.

8. Apparatus as defined in claim 6, wherein [one of said housing shells (30) said locking means includes a catch pin (34) on one of said housings, catch pin recess (36), thereby to align and lock said housing shells together.

* * * * *